United States Patent [19]

Hart

[11] 4,397,375

[45] Aug. 9, 1983

[54] LADDER POSITIONING AND HOLDING STRUCTURE

[76] Inventor: Russell J. Hart, 740 S. Waverly, Dearborn, Mich. 48124

[21] Appl. No.: 226,054

[22] Filed: Jan. 19, 1981

[51] Int. Cl.[3] ..... E06C 7/48

[52] U.S. Cl. ..... 182/206; 182/45; 182/129; 182/214

[58] Field of Search ..... 182/214, 206, 45, 127, 182/129, 120, 107, 108

[56] References Cited

U.S. PATENT DOCUMENTS

| | | | |
|---|---|---|---|
| 1,494,267 | 5/1924 | Melsha | 182/120 |
| 1,658,753 | 2/1928 | Wirth | 182/120 |
| 2,272,642 | 2/1942 | Owen | 182/206 |
| 2,803,388 | 8/1957 | Ross | 182/206 |
| 4,049,283 | 9/1977 | Brookes | 182/127 |

*Primary Examiner*—Reinaldo P. Machado

*Attorney, Agent, or Firm*—Barnes, Kisselle, Raisch, Choate, Whittemore & Hulbert

[57] ABSTRACT

A clamping member and a holding member adapted to be positioned on opposite sides of a ladder adjacent the top thereof extending in a direction perpendicular to the ladder and clamping means for clamping the ladder between the clamping member and holding member whereby the ladder may be positioned and held on a peaked roof or the like.

10 Claims, 5 Drawing Figures

FIG. 1
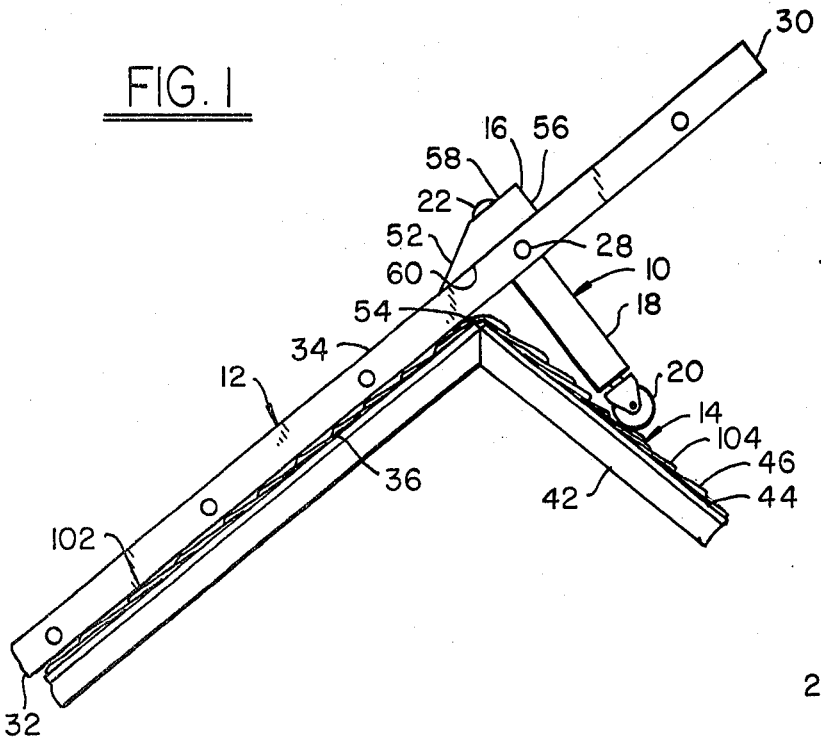
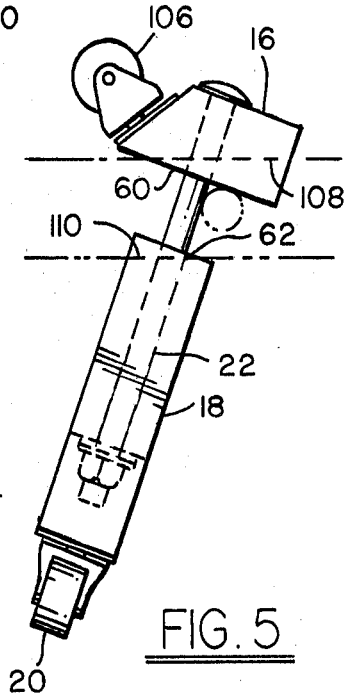
FIG. 5
FIG. 2
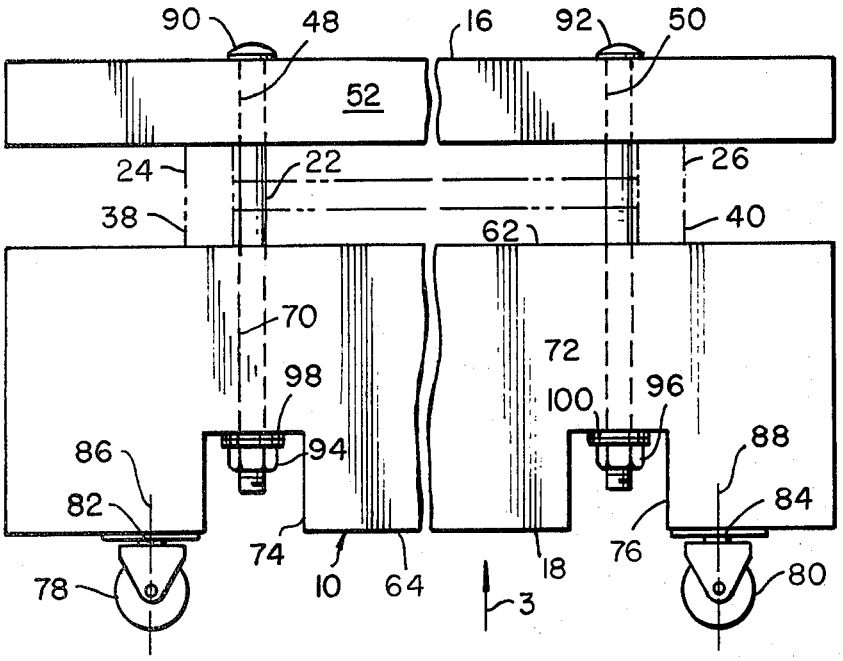
FIG. 4
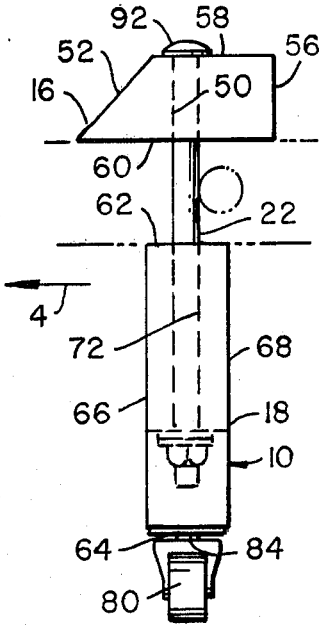
FIG. 3
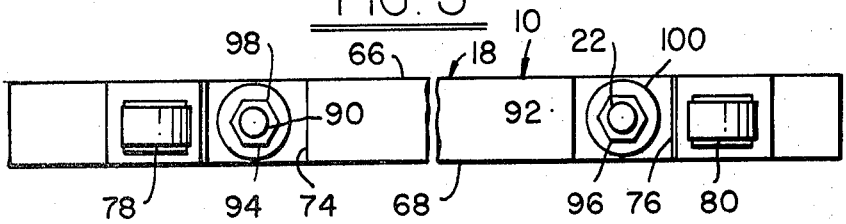

LADDER POSITIONING AND HOLDING STRUCTURE

BACKGROUND OF THE INVENTION

1. Field of the Invention

The invention relates to structure for positioning and holding a ladder on a peaked roof or the like and refers more specifically to a clamping member positioned across the front of a ladder adjacent the top thereof, a holding member positioned on the back of the ladder in alignment with the clamping member having rollers secured to the outer edge thereof and clamping means for securing the clamping member and holding member together with the ladder therebetween.

2. Description of the Prior Art

In the past, climbing on peaked roofs of houses and the like for purposes of removing articles from the roof, installation or repairing of roof mounted television antennas, or roof repair and the like, has been relatively dangerous. Modern peaked roofs provide no ready hand or foot holds and may be slippery when wet, hot in the summer months, and cold and icy in the winter. The danger when climbing on such roofs is of course increased with increased roof slope.

Climbing on such roofs is particularly dangerous for and objectionable to persons having a fear of heights.

In the past, commercial and industrial buildings have sometimes been provided with walkways or stationary means for aiding climbing on the exterior of the buildings. However, no portable means have been provided for facilitating climbing on a peaked roof.

SUMMARY OF THE INVENTION

In accordance with the invention, there is provided a structure for use in conjunction with a ladder to facilitate positioning of a ladder on one slope of a peaked roof, holding the ladder on the peaked roof, and subsequently removing the ladder from the peaked roof. The structure of the invention comprises a clamping member positioned across the front of the ladder adjacent the top thereof, a holding member positioned across the bottom of the ladder in alignment with the clamping member having rollers secured to the outer edge thereof and clamping means for securing the clamping and holding members together with the ladder in between them.

With such structure, the upper end of the ladder may be rolled up the roof and over the peak to position the ladder flat on one surface of the peaked roof at which time the ladder is held on the peaked roof by the holding member. When it is desired to remove the ladder from the peaked roof, the ladder is turned over on the front of the ladder and slid along the one surface of the peaked roof.

BRIEF DESCRIPTION OF THE DRAWINGS

FIG. 1 is an end view of the ladder positioning and holding structure of the invention in combination with a ladder and positioned on a peaked roof.

FIG. 2 is a front elevation of the ladder positioning and holding structure of the invention illustrating a ladder in conjunction therewith, in phantom.

FIG. 3 is a bottom view of the ladder positioning and holding structure shown in FIG. 2, taken in the direction of arrow 3 in FIG. 2.

FIG. 4 is an end view of the ladder positioning and holding structure shown in FIG. 2, taken in the direction of arrow 4 in FIG. 2.

FIG. 5 is an end view of modified ladder positioning and holding structure similar to the ladder positioning and holding structure of FIGS. 1–4, again showing a ladder in phantom in conjunction therewith, positioned at an angle other than 90° with respect thereto and showing additional rollers positioned on the clamping member.

DESCRIPTION OF THE PREFERRED EMBODIMENT

The ladder positioning and holding structure 10, as shown in FIG. 1 in conjunction with a ladder 12 and a peaked roof 14, includes a clamping member 16, a holding member 18 having roller means 20 secured thereto, and clamping means 22 for clamping the ladder 12 between the clamping member 16 and holding member 18.

The roof 14 is a peaked roof and may have any slope. Commonly, roof slopes are less than 45°. The roof 14 as shown includes the usual roof rafters 42, roof boards 44 and shingles 46.

In accordance with the usual structure, the ladder 12 includes the longitudinally spaced apart parallel side rails 24 and 26 and a plurality of ladder rungs 28 extending between the ladder rails 24 and 26 and spaced apart longitudinally thereof. Further, the ladder 12 includes an upper end 30, a lower portion 32, a front 34, a back 36, and sides 38 and 40, as shown best in FIGS. 1 and 2.

The clamping member 16 of the ladder positioning and holding structure 10, as shown, may be constructed of a two-by-four or two-by-six inch wood beam and has openings 48 and 50 extending therethrough for receiving the clamping means 22. The clamping member 16 further includes a beveled edge 52 for camming the clamping member 16 over the peak 54 of the roof 14 with the ladder 12 positioned on its front 34 during removal of the ladder from the roof, as will be seen subsequently. The clamping member 16 includes the edge 56 opposite the beveled edge 52 and the opposite sides 58 and 60.

The holding member 18 of the ladder positioning and holding structure 10, as shown, is a two-by-six or two-by-eight inch wood beam having opposite edges 62 and 64 and opposite sides 66 and 68. Openings 70 and 72 again extend through the holding member 18 for receiving the clamping means 22. Similarly, notches 74 and 76 are formed in the edge 64 of the holding member 18, as shown best in FIG. 2, for receiving the clamping means 22.

The roller means 20 includes rollers 78 and 80 secured to the edge 64 of the holding member 18. The rollers 78 and 80 are mounted on swivel connections 82 and 84, respectively, so as to permit rotation thereof about the center lines of the roller mountings 86 and 88, respectively. The center lines of the roller mountings split the holding member 18 evenly between the sides 66 and 68 and the rollers are of a diameter at least equal to the dimension of the holding member between the sides 66 and 68.

The clamping means 22 includes two bolts 90 and 92 extending through the aligned openings 48 and 70 and 50 and 72 in the aligned clamping and holding members 16 and 18, as shown. The clamping means further includes the bolts 94 and 96 and washers 98 and 100, respectively, which clamp the ladder between the clamping member 16 and holding member 18 in conjunction with the bolts 90 and 92, with the ladder positioning and holding structure in assembly with the ladder 12.

Thus, in use, with the ladder positioning and holding structure 10 clamped adjacent the upper end 30 of ladder 12 with the bolts 90 and 92 positioned against the lower edge of the rung 28, as shown in FIG. 1, and with the ladder rails 24 and 26 positioned just outside the bolts 90 and 92, as shown in FIG. 2, the ladder is positioned on the roof 14 by placing the roller means 20 on the side 102 of the peaked roof 14 and pushing the upper end of the ladder 30 toward the peak 54 of the roof 14 from the bottom of the ladder or from the lower edge of the side 102 of the roof 14. As the roller means 20 passes over the peak 54 of the roof 14 and starts down the other side 104 thereof, the ladder 12 will come to rest in surface to surface engagement with the side 102 of the roof 14.

At this time the holding member 18 holds the ladder 12 on the roof 14 to permit movement of a person up and down the ladder from the lower edge to the upper edge of the roof side 102, while providing excellent hand holds and foot holds. If it is desired to move the ladder along the roof, it is merely necessary to raise the bottom of the ladder from the lower edge of the side 102 of the roof and move the ladder along the roof. The swivel mounted roller means 20 will permit ready movement of the upper end 30 of the ladder and the ladder positioning and holding means secured thereto along the roof peak parallel thereto.

When it is desired to remove the ladder 14 from the roof, it is merely necessary to turn the ladder onto its front 34 and slide the ladder down the roof side 102. The clamping member 16 will cam over the roof peak 54 due to the beveled edge 52 thereon.

In the modification of the invention illustrated in FIG. 5, part 108 of the side surface 60 of the clamping member part 110 of the edge surface 62 of the holding member at the ladder rails are beveled so that the ladder positioning and holding structure 10 extends at an angle other than 90° to the ladder 12 in conjunction therewith. Such structure permits use of the ladder positioning and holding structure 10 with peaked roofs having an extreme slope, that is, greater than 45°.

Further, as shown in the modified structure of FIG. 5, additional roller means 106 may be positioned on the beveled edge 52 of the clamping member 16 to facilitate movement of the clamping member 56 over the peak 54 of the roof in removal of the ladder 12.

While one embodiment of the invention, together with a modification thereof, have been described in detail, it will be understood that other embodiments and modifications of the invention are contemplated. It is the intention to include all such embodiments and modifications within the scope of the invention as are defined by the appended claims.

What is claimed is:

1. In combination, a ladder having side rails and spaced apart ladder rungs extending between the ladder rails, said ladder including a front, back, an upper end, a lower portion and sides, and structure for positioning and holding the ladder on a peaked roof comprising a wood two-by-four beam clamping member including opposite edges and sides positioned on the front of the ladder adjacent the upper end thereof with one side of the two-by-four beam in surface to surface engagement with the upper edge of the ladder rails, a wood two-by-six beam holding member including opposite edges and sides having one edge positioned in surface to surface engagement with the bottom edge of the rails of the ladder extending substantially perpendicularly to the ladder in alignment with the clamping member, roller means secured to the opposite edge of the holding member adjacent each side rail of the ladder and outwardly of the side rails in a plane parallel to the plane of the ladder, notches in the opposite edge of the holding member adjacent each side rail of the ladder and inwardly of the side rails in a plane parallel to the plane of the ladder, and clamping means for securing the holding member with the rollers attached thereto and the clamping member together on the front and back of the ladder respectively with the ladder clamped therebetween, comprising bolts extending through the clamping member adjacent to but on the inside of the ladder rails and at the lower side of a ladder rung adjacent the top of the ladder and through the holding member between the edges thereof and nuts secured in the recesses in the holding member to the bolts.

2. Structure as set forth in claim 1, and further including swivel means for mounting the roller means on the opposite edge of the holding member.

3. Structure as set forth in claim 1, wherein the clamping member has a lower beveled edge extending toward the bottom of the associated ladder whereby when it is desired to remove the ladder from a peaked roof the associated ladder may be turned over with its front in contact with the roof and the clamping member may be cammed along the beveled surface over the roof peak.

4. Structure as set forth in claim 1, and further including roller means positioned on the clamping member for facilitating moving of the associated ladder from a peaked roof.

5. Structure as set forth in claim 1, wherein the roller means is positioned centrally of the sides of the holding member and has a diameter at least equal to the width of the holding member between the sides thereof in the longitudinal direction of extent of the associated ladder.

6. Structure as set forth in claim 1, wherein the holding member is adapted to extend perpendicularly to the associated ladder.

7. Structure as set forth in claim 1, wherein the holding member is adapted to extend at an angle of other than 90° with respect to the associated ladder.

8. In combination, a ladder having side rails and spaced apart ladder rungs extending between the ladder rails, said ladder including a front, back, an upper end, a lower portion and sides, and structure for positioning and holding the ladder on a peaked roof comprising a wood two-by-four beam clamping member including opposite edges and sides positioned on the front of the ladder adjacent the upper end thereof with one side of the two-by-four beam in surface to surface engagement with the upper edge of the ladder rails, said clamping member having a lower beveled edge extending toward the bottom of the associated ladder whereby when it is desired to remove the ladder from a peaked roof the associated ladder may be turned over with its front in contact with the roof and the clamping member may be cammed along the beveled surface over the roof peak, roller means positioned on the clamping member for facilitating moving of the associated ladder from a peaked roof, a wood two-by-six beam holding member including opposite edges and sides having one edge positioned in surface to surface engagement with the bottom edge of the rails of the ladder in alignment with the clamping member, roller means secured to the opposite edge of the holding member adjacent each side rail of the ladder and outwardly of the side rails in a plane parallel to the plane of the ladder, said roller means being positioned centrally of the sides of the holding member and having a diameter at least equal to the width of the holding member between the sides thereof in the longitudinal direction of extent of the associated ladder, swivel means for mounting the roller means on the opposite edge of the holding member, notches in the opposite edge of the holding member adjacent each side rail of the ladder and inwardly of the side rails in a plane parallel to the plane of the ladder, and clamping means for securing the holding member with the rollers attached thereto and the clamping member together on the front and back of the ladder respectively with the ladder clamped therebetween, comprising bolts extending through the clamping member adjacent to but on the inside of the ladder rails and at the lower side of a ladder rung adjacent the top of the ladder and through the holding member between the edges thereof and nuts secured in the recesses in the holding member to the bolts.

9. Structure as set forth in claim 8, wherein the holding member is adapted to extend perpendicularly to the associated ladder.

10. Structure as set forth in claim 8, wherein the holding member is adapted to extend at an angle of other than 90° with respect to the associated ladder.

* * * * *